US006667587B1

(12) United States Patent
Chang et al.

(10) Patent No.: US 6,667,587 B1
(45) Date of Patent: Dec. 23, 2003

(54) FLICKERING MODE CONTROL SYSTEM FOR A HIGH INTENSITY DISCHARGE LAMP

(75) Inventors: Wen-chou Chang, Hsinchu (TW); Chung-liang Wu, Tainan (TW)

(73) Assignee: Ever Bright Optoelectronics Co., Ltd., HsinChu (TW)

( * ) Notice: Subject to any disclaimer, the term of this patent is extended or adjusted under 35 U.S.C. 154(b) by 0 days.

(21) Appl. No.: 10/327,080

(22) Filed: Dec. 24, 2002

(51) Int. Cl.[7] ..... G05F 1/00

(52) U.S. Cl. ..... 315/291; 315/219; 315/224; 315/307; 315/DIG. 4

(58) Field of Search ..... 315/291, 209 R, 315/219, 224, 225, 282, 293, 205, 307, 200 R, DIG. 4, DIG. 7

(56) References Cited

U.S. PATENT DOCUMENTS 6,091,208 A * 7/2000 Flory, IV ..... 315/290
6,259,215 B1 * 7/2001 Roman ..... 315/307
6,329,767 B1 * 12/2001 Sievers ..... 315/307
6,448,713 B1 * 9/2002 Farkas et al. ..... 315/291
6,448,720 B1 * 9/2002 Sun ..... 315/219
6,507,157 B1 * 1/2003 Erhardt et al. ..... 315/224
6,555,971 B1 * 4/2003 Lestician ..... 315/224

* cited by examiner

*Primary Examiner*—Haissa Philogene
(74) *Attorney, Agent, or Firm*—Bacon & Thomas, PLLC

(57) ABSTRACT

A flickering mode control system, for operating a high intensity discharge lamp at a flickering mode, comprises an output power controllable transformer and a flickering control unit. The flickering control unit outputs a power modulation signal to a switch the output power controllable transformer for determining a power of a direct current signal output from the output power controllable transformer. In a relatively dim state of the flickering mode, the high intensity discharge lamp has a low enough illumination, resulting in that it looks like the high intensity discharge lamp is completely extinguished. Actually, the high intensity discharge lamp still remains illuminated even in the relatively dim state of the flickering mode. Therefore, the flickering mode is realized without the use of a hot restike ignitor, thereby increasing a lifetime of the high intensity discharge lamp and its operation safety.

19 Claims, 2 Drawing Sheets

FLICKERING MODE CONTROL SYSTEM FOR A HIGH INTENSITY DISCHARGE LAMP

BACKGROUND OF THE INVENTION

1. Field of the Invention

The present invention relates to a high intensity discharge (HID) lamp. More particularly, the present invention relates to an HID lamp capable of switching between a stable mode and a flickering mode after ignition. In the flickering mode, the high intensity discharge lamp has an intensity of illumination alternately varying at a human-visible frequency between a relatively bright state and a relatively dim state, in which the intensity of illumination in the relatively bright state is larger than that in the relatively dim state and the intensity of illumination in the relatively dim state is larger than zero.

2. Description of the Related Art

For commercial and industrial applications, the HID lamps such as metal halide (MH), high pressure sodium (HPS), and high pressure xenon (HPX) lamps have increasingly gained acceptance over incandescent and fluorescent lamps. The HID lamps are more efficient and more cost effective than incandescent and fluorescent lamps for illuminating large open spaces such as construction sites, stadiums, parking lots, warehouses, and so on, as well as for illumination along roadways. However, the conventional HID lamps cannot be operated at a flickering mode wherein their intensity of illumination alternately varies between a relatively bright state and a relatively dim state, resulting in an undesired restriction against an applicable range of the conventional HID lamps.

U.S. Pat. No. 6,448,720 discloses a HID lamp having only one operation mode after ignition, i.e. a constant intensity of illumination. U.S. Pat. No. 6,329,767 discloses a HID lamp having a dimmable intensity of illumination after ignition by using a dimmer, but a function of the dimmer is limited to monotonously reduce the intensity of illumination until zero instead of causing the intensity of illumination to flicker at a predetermined frequency. U.S. Pat. No. 6,448,713 and the prior art described therein disclose a HID lamp provided with a triac-based phase-control dimmer for controlling the intensity of illumination of the HID lamp by controlling a degree of voltage clamping through a duty cycle of output waveforms of the triac. However, a responsive voltage-current (V-I) curve to the dimmer is nonlinear since the HID lamp is driven by an alternating current, so it is difficult for the intensity of illumination to be accurately adjusted to a desired level.

Typically, the HID lamp includes at least an arc-tube containing two electrodes, chemical compounds, and a fill gas. The fill gas can include one or more gases. To initiate operation of the lamp, the fill gas is ionized to facilitate the conduction of electricity between the electrodes. For example, the conventional HPS lamp uses a 2500 to 4000 volt pulse for ignition. If the lamp is extinguished after lamp operation, the lamp cannot be restarted until after the lamp cools down and the fill gas can be ionized again. For many types of HID lamps, this lamp cooling period can be between approximately 40 seconds and 2.5 minutes.

Another method of restarting a HID lamp is to provide a hot restrike ignitor, which has been disclosed in U.S. Pat. No. 6,091,208. The hot restrike ignitor produces a pulse which is higher in voltage and contains significantly more energy than a pulse generated by a standard ignitor.

Consequently, if a flickering mode is realized for the HID lamp through a start-extinguish-restart manner, a lifetime of the HID lamp is adversely shortened. Moreover, from an operation safety point of view, it is very dangerous that the restart requires a considerably high voltage each time.

Therefore, the HID lamps are difficult to perform a flickering illumination as compared with the incandescent and fluorescent lamps.

SUMMARY OF THE INVENTION

In view of the above-mentioned problem, an object of the present invention is to provide a flickering mode control system for an HID lamp so as to flicker the HID lamp at a predetermined frequency.

Another object of the present invention is to provide a lighting apparatus with a flickering mode, in which an HID lamp serves as a light source, for realizing functional purposes such as indication, warning, defense, or attack, thereby substituting for incandescent and fluorescent lamps and enlarging an applicable range of the HID lamp.

According to one aspect of the present invention, a flickering mode control system for a high intensity discharge lamp includes an alternating-current to direct-current converter, an output power controllable transformer, a direct-current to alternating-current converter, a lamp driver unit, and a flickering control unit. The output power controllable transformer receives a direct current power supply and outputs a direct current signal. The output power controllable transformer is provided with a switch and determines a power of the direct current signal on the basis of an ON/OFF clock pulse signal for controlling the switch. Based on the a lamp current feedback signal received from between the output power controllable transformer and direct-current to alternating-current converter and a flickering activation signal received from the outside for operating the HID lamp at the flickering mode, the flickering control unit for outputting a power modulation signal as the ON/OFF clock pulse signal to the switch of the output power controllable transformer for controlling the power of the direct current signal to vary at the human-visible frequency.

According to another aspect of the present invention, a lighting apparatus with a flickering mode includes an HID lamp serving as a light source, and a flickering mode control system, thereby realizing functional purposes of indication, warning, defense, or attack through the flickering mode.

The flickering mode control system according to the present invention operates the HID lamp at the flickering mode in which the HID lamp has an intensity of illumination alternately varying at a human-visible frequency between a relatively bright state and a relatively dim state. The intensity of illumination of the HID lamp is extremely small in the relatively dim state of the flickering mode, resulting in that it looks like the HID lamp is completely extinguished. However, since the HID lamp is actually not extinguished in the relatively dim state of the flickering mode, there is no problem associated with the restart of the HID lamp. Therefore, the HID lamp is capable of operating at the flickering mode without a use of a hot restrike ignitor, thereby enhancing the lifetime of the HID lamp and the operation safety.

Since the flickering mode realizes the functional purposes such as indication, warning, defense, or attack, the range of applications of the HID lamp is expanded. Therefore, the present invention facilitates the HID lamp 20 to thoroughly substitute for incandescent and fluorescent lamps.

BRIEF DESCRIPTION OF THE DRAWINGS

The above-mentioned and other objects, features, and advantages of the present invention will become apparent with reference to the following descriptions and accompanying drawings wherein.

DETAILED DESCRIPTION OF THE PREFERRED EMBODIMENTS

The preferred embodiments according to the present invention will be described in detail with reference to the drawings.

Figure 1:
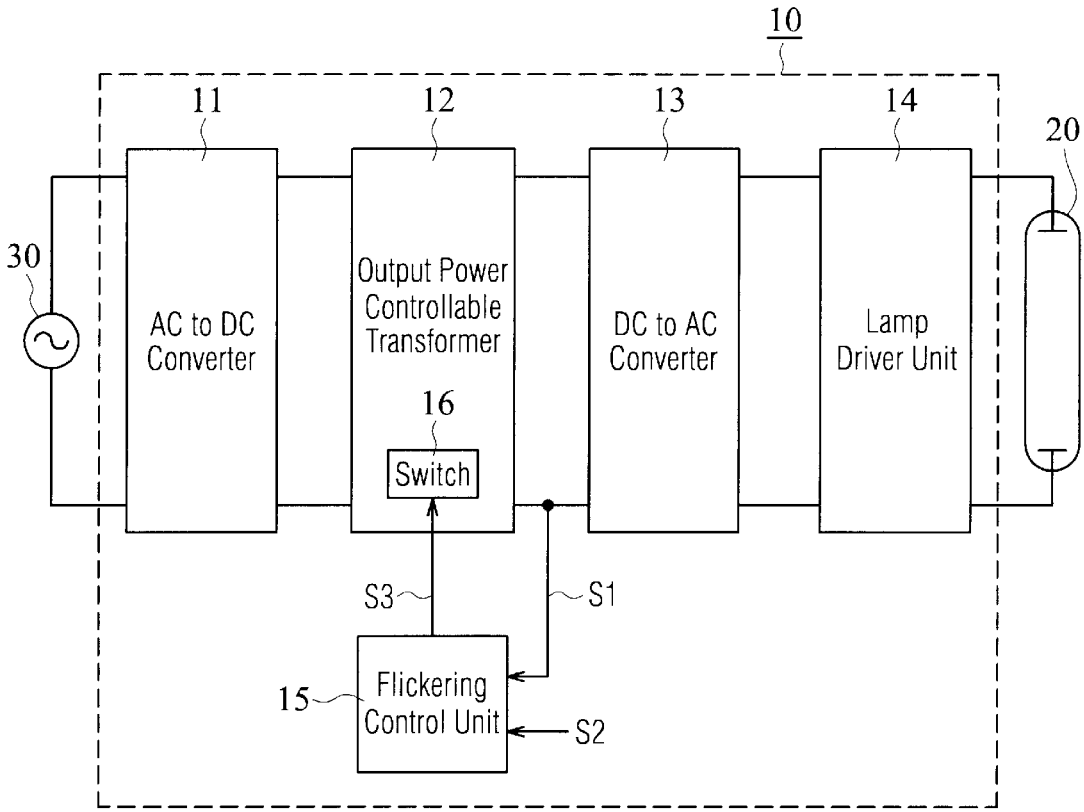
FIG. 1 is a block diagram showing a flickering mode control system according to the present invention.

FIG. 1 is a block diagram showing a flickering mode control system 10 according to the present invention. The flickering mode control system 10 according to the present invention operates an HID lamp 20 at a flickering mode. In the flickering mode, the HID lamp 20 has an intensity of illumination alternately varying at a human-visible frequency between a relatively bright state and a relatively dim state, in which the intensity of illumination in the relatively bright state is larger than that in the relatively dim state and the intensity of illumination in the relatively dim state is larger than zero. In other words, at the relatively dim state of the flickering mode, the HID lamp 20 is not completely extinguished and there is still some current passing through the HID lamp 20, causing the HID lamp 20 to stay illuminated. The flickering mode control system 10 according to the present invention can cause the intensity of illumination of the HID lamp 20 to be small enough in the relatively dim state of the flickering mode, resulting in that it looks like the HID lamp 20 is completely extinguished. As a matter of fact, since the HID lamp 20 is not extinguished at the relatively dim state of the flickering mode, no problem associated with the restart of the HID lamp 20 arises. Therefore, the HID lamp 20 is allowed to flicker at the human-visible frequency between the relatively bright state and the relatively dim state without a hot restrike ignitor. As a result, a lifetime of the HID lamp 20 and its operation safety are enhanced.

Referring to FIG. 1, the flickering mode control system 10 includes an alternating-current (AC) to direct-current (DC) converter 11, an output power controllable transformer 12, a DC to AC converter 13, a lamp driver unit 14, and a flickering control unit 15.

The AC to DC converter 11 receives an AC power supply 30 and then outputs a DC power supply. The output power controllable transformer 12 receives the DC power supply from the AC to DC converter 11 and then outputs a DC signal. Moreover, the output power controllable transformer 12 is provided with a switch 16 and determines a power of the DC signal based on an ON/OFF clock pulse signal for controlling the switch 16. The DC to AC converter 13 receives the DC signal from the output power controllable transformer 12 and then outputs an AC signal. The lamp driver unit 14 receives the AC signal from the DC to AC converter 13 and then outputs a driving signal to the HID lamp 20 for igniting the HID lamp 20 to illuminate.

Based on a lamp current feedback signal SI received between the output power controllable transformer 12 and the DC to AC converter 13 and a flickering activation signal S2 received from the outside for enabling the HID lamp 20 to operate at a flickering mode, the flickering control unit 15 outputs a power modulation signal S3 as the ON/OFF clock pulse signal to the switch 16 of the output power controllable transformer 12, for controlling the power of the DC signal to vary at the human-visible frequency. For example, the human-visible frequency is in a range of 1 Hz to 10 Hz. When the power of the DC signal is relatively high, the HID lamp 20 operates at the relatively bright state. When the power of the DC signal is relatively low, the HID lamp 20 operates at the relatively dim state. For example, a lamp current passing through the HID lamp 20 at the relatively bright state is twice or more than that passing through the HID lamp 20 at the relatively dim state.

When the flickering control unit 15 does not receive the flickering activation signal S2 or the flickering activation signal S2 is not at an enable state, the HID lamp 20 operates at a stable mode. In the stable mode, the HID lamp 20 has an intensity of illumination which is constant and larger than zero. For example, the intensity of illumination at the stable mode is smaller than that of the relatively bright state and is larger than that of the relatively dim state. With the flickering mode control system 10, the HID lamp 20 can switch between the stable mode and the flickering mode after ignition.

Figure 2A:
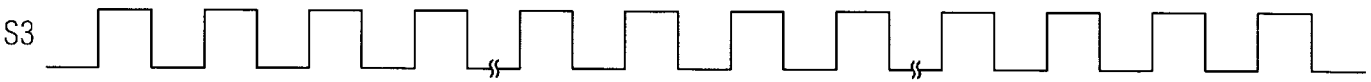
FIGS. 2(*a*), 2(*b*), and 2(*c*) are timing charts showing pulse waveforms of a power modulation signal in a stable mode and a flickering mode, respectively, according to the present invention.
Figure 2B:
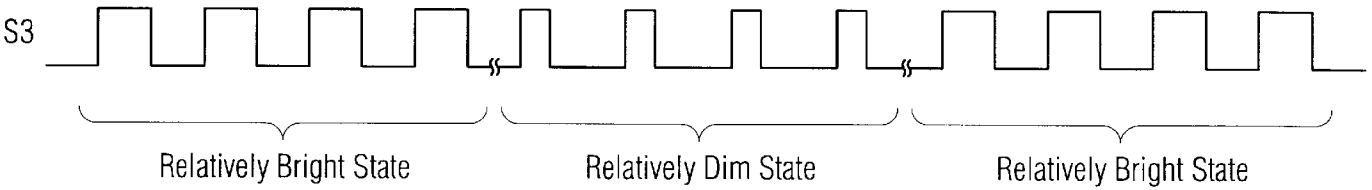
Figure 2C:
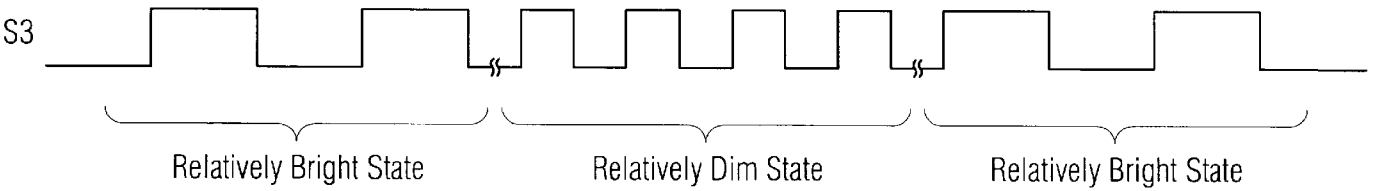

FIGS. 2(*a*), 2(*b*), and 2(*c*) are timing charts showing pulse waveforms of a power modulation signal in a stable mode and a flickering mode, respectively, according to the present invention. Referring to FIG. 2(*a*), in the stable mode, a duty cycle of the power modulation signal S3 stays fixed as time elapses. Consequently, when the power modulation signal S3 shown in FIG. 2(*a*) is input as the ON/OFF clock pulse signal into the switch 16 of the output power controllable transformer 12, the DC signal from the output power controllable transformer 12 has a constant power. As a result, the HID lamp 20 operates at the stable mode.

Referring to FIG. 2(*b*), in the flickering mode, the duty cycle of the power modulation signal S3 varies at the human-visible frequency. Consequently, when the power modulation signal S3 shown in FIG. 2(*b*) is input as the ON/OFF clock pulse signal into the switch 16 of the output power controllable transformer 12, the DC signal from the output power controllable transformer 12 has a power varying at the human-visible frequency. More specifically, when a part of the power modulation signal S3 having a smaller duty cycle is input to the switch 16, the DC signal from the output power controllable transformer 12 has a smaller power, thereby achieving the relatively dim state. When a part of the power modulation signal S3 having a larger duty cycle is input to the switch 16, the DC signal from the output power controllable transformer 12 has a larger power, thereby achieving the relatively bright state.

In addition to the modulation of the duty cycle of the power modulation signal S3, the flickering mode according to the present invention can also be achieved by modulating a pulse frequency of the power modulation signal S3. Referring to FIG. 2(*c*), although the power modulation signal S3 has the same duty cycle regardless of the relatively bright state and the relatively dim state, the pulse frequency of the power modulation signal S3 at the relatively bright state is half of that at the relatively dim state. In this case, the DC signal from the output power controllable transformer 12 has a power which is determined by the pulse frequency of the power modulation signal S3, thereby achieving the flickering mode according to the present invention.

Needless to say, a person skilled in the art appreciates from the descriptions above that the power modulation signal S3 for achieving the flickering mode according to the present invention is not limited to those shown in FIGS. 2(*b*) and 2(*c*). For example, it is possible to simultaneously modulate the duty cycle and the pulse frequency of the power modulation signal S3 in order to achieve the flickering mode.

Figure 3:
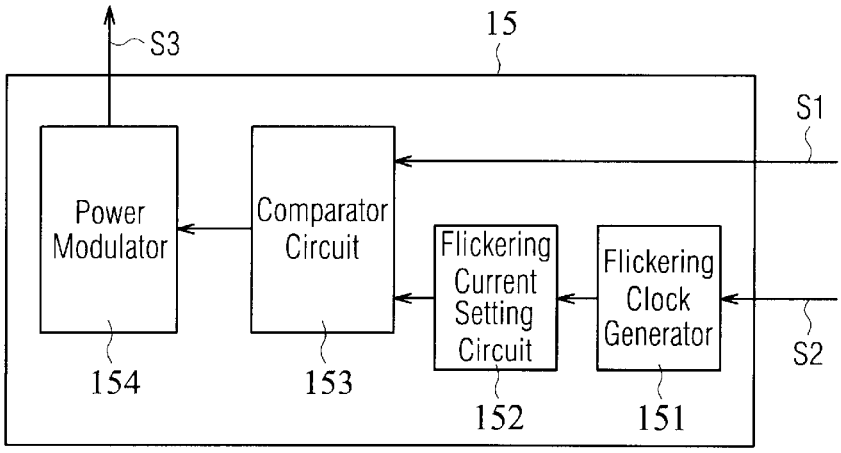
FIG. 3 is a detailed block diagram showing a flickering control unit in a flickering mode control system according to the present invention.

FIG. 3 is a detailed block diagram showing a flickering control unit 15 in a flickering mode control system 10 according to the present invention. Referring to FIG. 3, a flickering control unit 15 includes a flickering clock generator 151, a flickering current setting circuit 152, a comparator circuit 153, and a power modulator 154.

The flickering clock generator 151 receives the flickering activation signal S2 and outputs a flickering clock pulse signal having the human-visible frequency. The flickering current setting circuit 152 receives the flickering clock pulse signal and outputs a flickering current setting signal. The comparator 153 compares the lamp current feedback signal S1 and the flickering current setting signal and then, based on a result of the comparison, outputs a flickering current signal. The power modulator 154 receives the flickering current signal and outputs the power modulation signal S3 to the switch 16 of the output power controllable transformer 12.

With the flickering mode control system 10 according to the present invention, the HID lamp 20 can be operated at a flickering mode. Since the flickering mode realizes functional purposes such as indication, warning, defense, or attack, an applicable range of the HID lamp is greatly expanded. Therefore, the present invention facilitates the HID lamp 20 to thoroughly substitute for incandescent and fluorescent lamps.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A flickering mode control system for operating a high intensity discharge (HID) lamp at a flickering mode in which the HID lamp has an intensity of illumination alternately varying at human-visible frequency between a relatively bright state and a relatively dim state, the intensity of illumination at the relatively bright state being larger than that at the relatively dim state and the intensity of illumination at the relatively dim state being larger than zero, the flickering mode control system comprising:

an output power controllable transformer provided with a switch for receiving a direct current (DC) power supply and outputting a DC signal, in which a power of the DC signal is determined on the basis of an ON/OFF clock pulse signal for controlling the switch;

a DC to alternating-current (AC) converter for receiving the DC signal and outputs an AC signal;

a lamp driver unit for receiving the AC signal and outputs a driving signal to the HID lamp for igniting the HID lamp; and a flickering control unit for outputting a power modulation signal as the ON/OFF clock pulse signal to the switch of the output power controllable transformer, based on a lamp current feedback signal received between the output power controllable transformer and the DC to AC converter and a flickering activation signal received from the outside for operating the HID lamp at the flickering mode, for controlling the power of the DC signal to vary at the human-visible frequency, wherein when the power of the DC signal is relatively high, the HID lamp is operated at the relatively bright state and when the power of the DC signal is relatively low, the HID lamp is operated at the relatively dim state.

2. The system according to claim 1, further comprising:

an AC to DC converter for receiving an AC power supply and outputting the DC power supply to the output power controllable transformer.

3. The system according to claim 1, wherein the human-visible frequency is in a range of 1 Hz to 10 Hz.

4. The system according to claim 1, wherein a lamp current passing through the HID lamp at the relatively bright state is twice or more than that at the relatively dim state.

5. The system according to claim 1, wherein when the flickering control unit does not receive the flickering activation signal or the flickering activation signal is not at an enable state, the HID lamp operates at a stable mode in which the HID lamp has an intensity of illumination which is constant and larger than zero.

6. The system according to claim 5, wherein the intensity of illumination at the stable mode is smaller than that of the relatively bright state and is larger than that of the relatively dim state.

7. The system according to claim 1, wherein the power modulation signal serving as the ON/OFF clock pulse signal has such a duty cycle varying at the human-visible frequency that the power of the DC signal is controlled to vary at the human-visible frequency.

8. The system according to claim 1, wherein the power modulation signal serving as the ON/OFF clock pulse signal has such a pulse frequency varying at the human-visible frequency that the power of the DC signal is controlled to vary at the human-visible frequency.

9. The system according to claim 1, wherein the flickering control unit comprises:

a flickering clock generator for receiving the flickering activation signal and outputting a flickering clock pulse signal having the human-visible frequency;

a flickering current setting circuit for receiving the flickering clock pulse signal and outputting a flickering current setting signal;

a comparator circuit for comparing the lamp current feedback signal and the flickering setting signal and, based on a result of the comparison, outputting a flickering current signal; and a power modulator for receiving the flickering current signal and outputting the power modulation signal.

10. A lighting apparatus with a flickering mode, comprising:

an HID lamp serving as a light source; and a flickering mode control system for operating the HID lamp at the flickering mode in which the HID lamp has an intensity of illumination alternately varying at a human-visible frequency between a relatively bright state and a relatively dim state, the intensity of illumination at the relatively bright state being larger than that at the relatively dim state and the intensity of illumination at the relatively dim state being larger than zero, the flickering mode control system comprising:

an output power controllable transformer provided with a switch for receiving a DC power supply and outputting a DC signal, in which a power of the DC signal is determined on the basis of an ON/OFF clock pulse signal for controlling the switch;

a DC to AC converter for receiving the DC signal and outputs an AC signal;

a lamp driver unit for receiving the AC signal and outputs a driving signal to the HID lamp for igniting the HID lamp; and a flickering control unit for outputting a power modulation signal as the ON/OFF clock pulse signal to the switch of the output power controllable transformer, based on a lamp current feedback signal received between the output power controllable transformer and DC to AC converter and a flickering activation signal received from the outside for operating the HID lamp at the flickering mode, for controlling the power of the DC signal to vary at the human-visible frequency, wherein when the power of the DC signal is relatively high, the HID lamp is operated at the relatively bright state and when the power of the DC signal is relatively low, the HID lamp is operated at the relatively dim state.

11. The lighting apparatus according to claim 10, wherein the flickering mode realizes functional purposes of indication, warning, defense, or attack.

12. The lighting apparatus according to claim 10, further comprising:

an AC to DC converter for receiving an AC power supply and outputting the DC power supply to the output power controllable transformer.

13. The lighting apparatus according to claim 10, wherein the human-visible frequency is in a range of 1 Hz to 10 Hz.

14. The lighting apparatus according to claim 10, wherein a lamp current passing through the HID lamp at the relatively bright state is twice or more than that at the relatively dim state.

15. The lighting apparatus according to claim 10, wherein when the flickering control unit does not receive the flickering activation signal or the flickering activation signal is not at an enable state, the HID lamp operates at a stable mode in which the HID lamp has an intensity of illumination which is constant and larger than zero.

16. The lighting apparatus according to claim 15, wherein the intensity of illumination at the table mode is smaller than that of the relatively bright state and is larger than that of the relatively dim state.

17. The lighting apparatus according to claim 10, wherein the power modulation signal serving as the ON/OFF clock pulse signal has such a duty cycle varying at the human-visible frequency that the power of the DC signal is controlled to vary at the human-visible frequency.

18. The lighting apparatus according to claim 10, wherein the power modulation signal serving as the ON/OFF clock pulse signal has such a pulse frequency varying at the human-visible frequency that the power of the DC signal is controlled to vary at the human-visible frequency.

19. The lighting apparatus according to claim 10, wherein the flickering control unit comprises:

a flickering clock generator for receiving the flickering activation signal and outputting a flickering clock pulse signal having the human-visible frequency;

a flickering current setting circuit for receiving the flickering clock pulse signal and outputting a flickering current setting signal;

a comparator circuit for comparing the lamp current feedback signal and the flickering setting signal and, based on a result of the comparison, outputting a flickering current signal; and a power modulator for receiving the flickering current signal and outputting the power modulation signal.

* * * * *